US010586511B2

(12) United States Patent
Yang et al.

(10) Patent No.: US 10,586,511 B2
(45) Date of Patent: Mar. 10, 2020

(54) DISPLAY PANEL, DRIVING METHOD, AND DISPLAY DEVICE

(71) Applicant: Shanghai Tianma AM-OLED Co., Ltd., Shanghai (CN)

(72) Inventors: Bin Yang, Shanghai (CN); Bojia Lv, Shanghai (CN); Xiangzi Kong, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/229,096

(22) Filed: Dec. 21, 2018

(65) Prior Publication Data

US 2019/0206363 A1 Jul. 4, 2019

(30) Foreign Application Priority Data

Jan. 3, 2018 (CN) ..... 2018 1 0004922

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2310/0232* (2013.01); *G09G 2320/0285* (2013.01); *G09G 2320/0626* (2013.01); *G09G 2320/0686* (2013.01)

(58) Field of Classification Search
None
See application file for complete search history.

(56) References Cited

U.S. PATENT DOCUMENTS

2008/0088568 A1* 4/2008 Haga ..... G09G 3/18 345/100
2009/0309813 A1* 12/2009 Fujita ..... G02F 1/133512 345/55
2010/0156945 A1* 6/2010 Yoshida ..... G02F 1/1345 345/690
2017/0357113 A1* 12/2017 Yamazaki ..... G02B 5/30
2018/0012566 A1* 1/2018 Lin ..... G09G 5/10
2018/0075797 A1* 3/2018 Park ..... G09G 3/2092
2018/0151612 A1* 5/2018 Zheng ..... G09G 3/20
2018/0357979 A1* 12/2018 Nakamura ..... G09G 5/10
2019/0088188 A1* 3/2019 Zheng ..... G09G 3/2074
2019/0227395 A1* 7/2019 Nakanishi ..... G02F 1/134363

* cited by examiner

*Primary Examiner* — Dorothy Harris
(74) *Attorney, Agent, or Firm* — Tarolli, Sundheim, Covell & Tummino LLP

(57) ABSTRACT

A display panel, a driving method, and a display device are provided. The display panel includes display area including main display area and auxiliary display area. Auxiliary display area has a smaller length than the main display area in row direction. Each auxiliary display area includes first display area, and non-rectangular display area having curved edge. First boundary is between each non-rectangular display area and first display area. Second boundary is between each non-rectangular display area and main display area. Each sector-shaped region has a vertex that is a center of circle corresponding to curved edge. Each sector-shaped region has attenuation transition zone having smaller width than radius of sector-shaped region. Width of attenuation transition zone adjacent to first boundary and width of attenuation transition zone adjacent to second boundary are smaller than width of attenuation transition zone of other sector-shaped regions.

12 Claims, 5 Drawing Sheets

DISPLAY PANEL, DRIVING METHOD, AND DISPLAY DEVICE

CROSS-REFERENCE TO RELATED APPLICATIONS

The present application claims priority to Chinese Patent Application No. 201810004922.8, filed on Jan. 3, 2018, the content of which is incorporated herein by reference in its entirety.

TECHNICAL FIELD

The present disclosure relates to the field of display technologies, and in particular, to a display panel, a driving method thereof, and a display device.

BACKGROUND

With the continuous development of display technologies and diversified needs of users on the appearance of a display panel, non-rectangular display panels are more and more widely used. The display panel includes a display area including a non-rectangular display area and a normal display area. The non-rectangular display area has a curved edge. Based on an arrangement of pixels, the pixels at the curved edge of the non-rectangular display area are arranged in a zigzag manner. In order to make an edge of an image displayed by the non-rectangular display area be closer to an ideal arc shape, in the related art, a brightness attenuation area is usually provided in the non-rectangular display area. Within the brightness attenuation area, the brightness of the pixels is gradually attenuated so as to eliminate the zigzag phenomenon of the edge.

However, in this way, an unsmooth brightness transition appears at a boundary between the non-rectangular display area and the normal display area, which results in a poor display effect.

SUMMARY

In view of this, the present disclosure provides a display panel, a driving method thereof, and a display device, so as to solve the problem of an unsmooth brightness transition that appears between the non-rectangular display area and the normal display area.

In an aspect, the present disclosure provides a display panel, which includes a display area. The display area comprises a main display area and at least one auxiliary display area, and each of the at least one auxiliary display area has a smaller length than the main display area in a row direction, each of the at least one auxiliary display area comprises a first display area and at least one non-rectangular display area, and each of the at least one non-rectangular display area has a curved edge. A first boundary is between each of the at least one non-rectangular display area and the first display area, and a second boundary is between each of the at least one non-rectangular display area and the main display area. One non-rectangular display area of the at least one non-rectangular display area comprises a plurality of sector-shaped regions, the curved edge of the one non-rectangular display area comprises a plurality of curved sub-edges, each of the plurality of sector-shaped regions corresponds to a respective one of the plurality of curved sub-edges, and each of the plurality of sector-shaped regions has a vertex that is a center of circle corresponding to the respective curved edge. Each of the plurality of sector-shaped regions has an attenuation transition zone, the attenuation transition zone has a width smaller than a radius of one of the plurality of sector-shaped regions where the attenuation transition zone is located; both a width of the attenuation transition zone of one of the plurality of sector-shaped regions adjacent to the first boundary and a width of the attenuation transition zone of one of the plurality of sector-shaped regions adjacent to the second boundary are smaller than a width of the attenuation transition zone of any one of other sector-shaped regions. A brightness of pixels in each attenuation transition zone is gradually attenuated along a direction from the center of a circle toward a corresponding one of the plurality of curved sub-edges.

In another aspect, the present disclosure provides a method for driving a display panel, which is applied to any display panel provided in the present disclosure. The method includes: controlling brightness of pixels to be gradually attenuated in the attenuation transition zone of each sector-shaped region in the non-rectangular display area along a direction from the center of circle toward the curved sub-edge.

In still another aspect, the present disclosure provides a display device, which includes any display panel provided in the present disclosure.

BRIEF DESCRIPTION OF DRAWINGS

In order to more clearly illustrate technical solutions in embodiments of the present disclosure or in the related art, the accompanying drawings used in the embodiments and in the related art are briefly introduced as follows. It should be noted that the drawings described as follows are merely part of the embodiments of the present disclosure, other drawings can also be acquired by those skilled in the art without paying creative efforts.

DESCRIPTION OF EMBODIMENTS

For better illustrating technical solutions of the present disclosure, embodiments of the present disclosure will be described in detail as follows with reference to the accompanying drawings.

It should be noted that, the described embodiments are merely exemplary embodiments of the present disclosure, which shall not be interpreted as providing limitations to the present disclosure. All other embodiments obtained by those skilled in the art without creative efforts according to the embodiments of the present disclosure are within the scope of the present disclosure.

The terms used in the embodiments of the present disclosure are merely for the purpose of describing particular embodiments but not intended to limit the present disclosure. Unless otherwise noted in the context, the singular form expressions "a", "an", "the" and "said" used in the embodiments and appended claims of the present disclosure are also intended to represent plural form expressions thereof.

It should be understood that the term "and/or" used herein is merely an association relation describing associated objects, indicating that there may be three relations, for example, A and/or B may indicate that three cases, i.e., A existing individually, A and B existing simultaneously, B existing individually. In addition, the character "/" herein generally indicates that the related objects before and after the character form an "or" relation.

It should be understood that although boundary may be described using the terms of "first", "second", etc., in the embodiments of the present disclosure, the boundary will not be limited to these terms. These terms are merely used to distinguish boundaries from one another. For example, without departing from the scope of the embodiments of the present disclosure, a first boundary may also be referred to as a second boundary, similarly, a second boundary may also be referred to as a first boundary.

Figure 1:
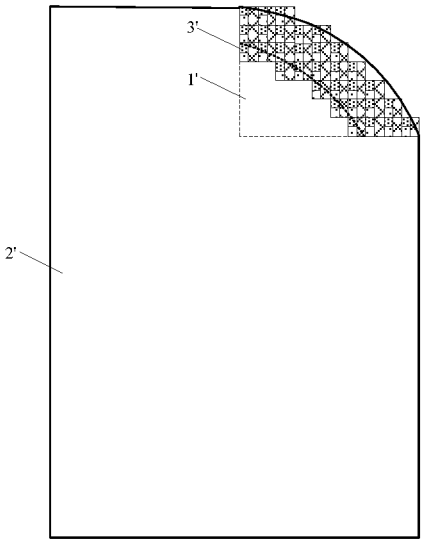
FIG. 1 (Prior art)
FIG. 1 is a schematic structural diagram of a non-rectangular display panel in the related art.

As shown in FIG. 1, FIG. 1 is a schematic structural diagram of a non-rectangular display panel. The display panel includes a display area including a non-rectangular display area 1' and a normal display area 2'. The non-rectangular display area 1' has a curved edge. Based on an arrangement of pixels 3', the pixels at the curved edge of the non-rectangular display area 1' are arranged in a zigzag manner. In order to make an edge of an image displayed by the non-rectangular display area 1' be closer to an ideal arc shape, in the related art, a brightness attenuation area 3' is usually provided in the non-rectangular display area 1'. Within the brightness attenuation area 3', the brightness of the pixels 3' is gradually attenuated so as to eliminate the zigzag phenomenon of the edge.

However, in this way, unsmooth brightness transition appears at a boundary between the non-rectangular display area 1' and the normal display area 2', which results in a poor display effect.

Figure 2:
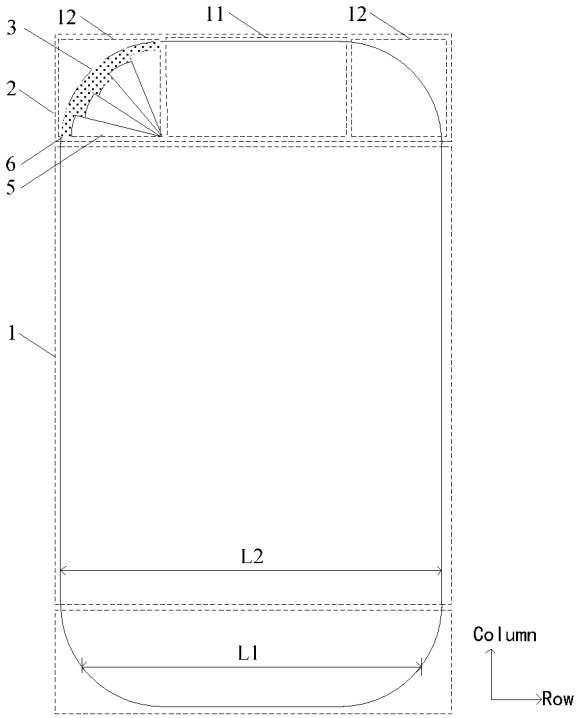
FIG. 2 is a top view of a display panel according to an embodiment of the present disclosure.

An embodiment of the present disclosure provides a display panel. As shown in FIG. 2, a display area of the display panel includes a main display area 1 and an auxiliary display area 2. A length L1 of the auxiliary display area 2 in a row direction is smaller than a Length L2 of the main display area 1 in the row direction. The auxiliary display area 2 includes a first display area 11 and a non-rectangular display area 12, and the non-rectangular display area 12 has a curved edge 3. A first boundary is between the non-rectangular display area 12 and the first display area 11, and a second boundary is between the non-rectangular display area 12 and the main display area 1.

It should be noted that the boundary between the non-rectangular display area 12 and the first display area 11 is defined as a first boundary, and the boundary between the non-rectangular display area 12 and the main display area 1 is defined as a second boundary, such definitions are merely for clearly illustrating the technical solution of the embodiments, and the first boundary and the second boundary are not physically set in the display panel.

Figure 3:
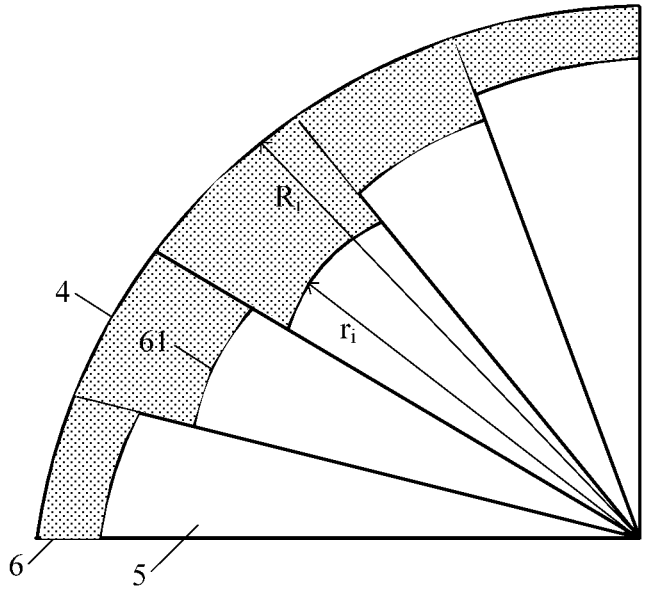
FIG. 3 is schematic structural diagram I of a non-rectangular display area of a display panel according to an embodiment of the present disclosure.

With reference to FIG. 2 and FIG. 3, the curved edge 3 includes a plurality of curved sub-edges 4, and the non-rectangular display area 12 includes a plurality of sector-shaped regions 5 one-to-one corresponding to the plurality of curved sub-edges 4. A vertex of each sector-shaped region 5 is a center of circle of the curved edge 3. Each sector-shaped region 5 has an attenuation transition zone 6, and a width of each attenuation transition zone 6 is smaller than a radius of the respective sector-shaped region 5. Either the width of the attenuation transition zone 6 of the sector region 5 adjacent to the first boundary or the width of the attenuation transition zone 6 of the sector region 5 adjacent to the second boundary is smaller than the width of any other attenuation transition zone 6. In each attenuation transition zone 6, brightness of the pixels gradually decreases along a direction from the center of circle toward the curved sub-edge 4.

With further reference to FIG. 3, each attenuation transition zone 6 includes a first edge and a second edge 61 opposite to the first edge. The first edge is the curved sub-edge 4 corresponding to the sector-shaped region 5 in which the attenuation transition zone 6 is located. In an attenuation transition zone 6, the radius of the first edge with respect to the center of circle is $R_i$, and the radius of the second edge 61 with respect to the center of circle is $r_i$. The width of the attenuation transition zone 6 refers to a distance between the first edge and the second edge 61, i.e., $R_i$-$r_i$.

For a display panel provided by an embodiment of the present disclosure, the non-rectangular display area 12 includes a plurality of sector-shaped regions 5, and each sector-shaped region 5 includes an attenuation transition zone 6. The brightness of the pixels in each attenuation transition zone 6 gradually decreases along the direction from the center of circle toward the curved sub-edge 4, so that the pixels with the zigzag arrangement at the curved edge 3 can have low brightness, thereby eliminating the zigzag and thus making the edge of the image displayed by the non-rectangular display area 12 be closer to a smooth arc shape. Further, either the width of the attenuation transition zone 6 of the sector region 5 adjacent to the first boundary or the width of the attenuation transition zone 6 of the sector region 5 adjacent to the second boundary is smaller than the width of any other attenuation transition zone 6, so that when controlling brightness attenuation of the pixels, for pixels at the first boundary and the second boundary, only the pixels in the attenuation transition zone 6 have brightness attenuation, and thus the brightness attenuation range of the pixels at the first boundary and the second boundary can be narrowed. Compared with the related art, the display panel provided by this embodiment can alleviate the problem of unsmooth brightness transition at the first boundary and the second boundary caused by the brightness attenuation of the pixels, so that the image displayed at the first boundary and the second boundary can be softer.

Exemplarily, with further reference to FIG. 2, the display area may include two auxiliary display areas 2, each of which includes two non-rectangular display areas 12. In each auxiliary display area 2, a non-rectangular display area 12, a first display area 11, and the other non-rectangular display area 12 are sequentially arranged in the row direction.

It should be noted that when the display area of the display panel includes a plurality of non-rectangular display areas 12, the structure of each non-rectangular display area 12 is the same as that of the non-rectangular display area 12 described above. Moreover, the shape of the display area shown in FIG. 2 is merely illustrative, and the shape of the display area is not limited thereto. The display area may also include one, two or three non-rectangular display areas 12, and the shape of the display area can be configured according to the shape of the display panel, which is not limited herein by the embodiments.

In an embodiment, the non-rectangular display area 12 includes N sector-shaped regions 5 arranged in sequence. The $1^{st}$ sector-shaped region is adjacent to the first boundary, and the $N^{th}$ sector-shaped region is adjacent to the second boundary. The respective widths of respective attenuation transition zones 6 of the sector-shaped regions 5 are decreased along a direction from a middle region toward each edge region.

When N is an even number, a $(N/2)^{th}$ sector-shaped region and a $(N/2+1)^{th}$ sector-shaped region are located in the middle region. The respective widths of respective attenuation transition zones of the sector-shaped regions are decreased along a direction from the $(N/2)^{th}$ sector-shaped region toward the $1^{st}$ sector-shaped region. The respective widths of respective attenuation transition zones of the sector-shaped regions are decreased along a direction from the $(N/2+1)^{th}$ sector-shaped region toward the $N^{th}$ sector-shaped region.

When N is an odd number, a $((N+1)/2)^{th}$ sector-shaped region is located in the middle region. The respective widths of respective attenuation transition zones of the sector-shaped regions are decreased along a direction from the $((N+1)/2)^{th}$ sector-shaped region toward the $1^{st}$ sector-shaped region. The respective widths of respective attenuation transition zones of the sector-shaped regions are decreased along a direction from the $((N+1)/2)^{th}$ sector-shaped region toward the $N^{th}$ sector-shaped region.

The respective widths of respective attenuation transition zones 6 of the sector-shaped regions 5 are decreased along a direction from a middle region toward each edge region. In this way, either the width of the attenuation transition zone 6 of the sector-shaped region 5 adjacent to the first boundary or the width of the attenuation transition zone 6 of the sector-shaped region 5 adjacent to the second boundary is smaller than the width of any other attenuation transition zone 6, moreover, the respective widths of respective transition zones 6 varies regularly in size. In such a manner, when controlling brightness attenuation of the pixels in the attenuation transition zones, the brightness variation range of the pixels in two adjacent sector-shaped regions 5 does not vary too much, thereby achieving a small brightness difference for the pixels at a position between the attenuation transition zones 6 of two adjacent sector-shaped regions 5, further weakening the brightness variation of the pixels in the non-rectangular display area 12, and thus improving the display quality.

Figure 4:
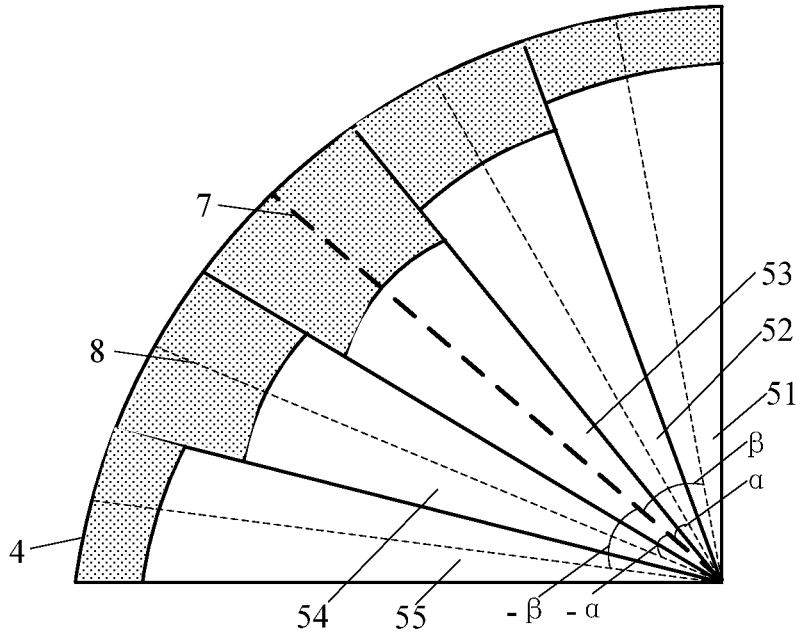
FIG. 4 is schematic structural diagram II of a non-rectangular display area of a display panel according to an embodiment of the present disclosure.

As shown in FIG. 4, in an embodiment, in order to make the division of the sector-shaped regions 5 more regular and reduce the complexity of the brightness control of the pixels, the curved edge 3 can be equally divided into N curved sub-edges 4, that is, the angles of the respective sector-shaped regions 5 are equal to each other.

When the angles of the respective sector-shaped regions 5 are equal to each other, the widths of the respective attenuation transition zones 6 in two sector-shaped regions 5, which are symmetric to each other with respect to a curved edge center line 7, may be the same. The curved edge center line 7 is a line connecting the center point of the curved edge 3 with the center of circle. In other word, when an absolute value of the angle between the $x^{th}$ sector-shaped region and the curved edge center line 7 is equal to an absolute value of the angle between the $y^{th}$ sector-shaped region and the curved edge center line 7, the width of the attenuation transition zone 6 of the $x^{th}$ sector-shaped region is same as the width of the attenuation transition zone 6 of the $y^{th}$ sector-shaped region, where $1 \le x \le N$, and $1 \le y \le N$.

In an embodiment, with further reference to FIG. 4, in an example, N=5, and the $1^{st}$ sector-shaped region 51 to the $5^{th}$ sector-shaped region 55 are sequentially arranged. The angle between the $2^{nd}$ sector-shaped region 52 and the curved edge center line 7 is $\alpha$, the angle between the $4^{th}$ sector-shaped region 54 and the curved edge center line 7 is $-\alpha$, and the width of the attenuation transition zone 6 of the second sector-shaped region 52 is the same as the width of the attenuation transition zone 6 of the fourth sector-shaped region 54. The angle between the $1^{st}$ sector-shaped region 51 and the curved edge center line 7 is $\beta$, the angle between the $5^{th}$ sector-shaped region 55 and the curved edge center line 7 is $-\beta$, and the width of the attenuation transition zone 6 of the $1^{st}$ sector-shaped region 51 is the same as the width of the attenuation transition zone 6 of the $5^{th}$ sector-shaped region 55.

It should be noted that each sector-shaped region 5 corresponds to a curved sub-edge center line 8, and the curved sub-edge center line 8 is a line connecting a center point of the curved sub-edge 4 corresponding to the sector-shaped region 5 with the center of circle. The angle between the sector-shaped region 5 and the curved edge center line 7 is the angle between the curved sub-edge center line 8 corresponding to the sector-shaped region 5 and the curved edge center line 7.

The respective attenuation transition zones 6 of respective sector-shaped regions 5, which are symmetrical with respect to the curved edge center line 7, have a same width. That is, the widths of the respective attenuation transition zones 6 of respective sector-shaped regions 5 located at two sides of the curved edge center line 7 are symmetrically changed, and in this way, the regularity of the width transition of the attenuation transition zones 6 can be further improved. Therefore, when controlling brightness attenuation of the pixels in the attenuation transition zones 6, the brightness variation of the pixels in the non-rectangular display area 12 can be further weakened, and the display quality can be improved. Moreover, the respective widths of the respective attenuation transition zones 6 of respective sector-shaped regions 5 located at two sides of the center line of the curved edge 3 are symmetrically changed, therefore, the complexity of controlling the brightness of the pixel can be reduced, and the operability is improved.

In an embodiment, the widths of the respective attenuation transition zones 6 in the sector-shaped regions 5 can vary linearly along a direction from the middle region toward both edge regions.

When N is an even number, in the $(N/2)^{th}$ sector-shaped region to the $1^{st}$ sector-shaped region, the width of each attenuation transition zone 6 and the angel between the corresponding sector-shaped region 5 and the curved edge center line 7 satisfy a first linear relation. In the $(N/2+1)^{th}$ sector-shaped region to the $N^{th}$ sector-shaped region, the width of each attenuation transition zone 6 and the angel between the corresponding sector-shaped region 5 and the curved edge center line 7 satisfy a second linear relation.

For further reducing the complexity of controlling the brightness of the pixel, the first linear relation may be the same as the second linear relation.

When N is an odd number, in the $((N+1)/2)^{th}$ sector-shaped region to the $1^{st}$ sector-shaped region, the width of each attenuation transition zone 6 and the angle between the corresponding sector-shaped region 5 and the curved edge center line 7 satisfy a third linear relation. In the $((N+1)/2)^{th}$ sector-shaped region to the $N^{th}$ sector-shaped region, the width of each attenuation transition zone 6 and the angle between the corresponding sector-shaped region 5 and the curved edge center line 7 satisfy a fourth linear relation.

For further reducing the complexity of controlling the brightness of the pixel, the third linear relation may be the same as the fourth linear relation.

It should be noted that the linear relation of the width of the attenuation transition zone 6 and the angle between the corresponding sector-shaped region 5 and the curved edge center line 7 can be determined according to the shape of the non-rectangular display area 12 and the required width of the attenuation transition zone 6. The expression corresponding to the linear relation may be a linear expression or a constant expression.

An embodiment of the present disclosure further provides a method for driving a display panel, which is applied to the display panel described above. The method for driving the display panel includes following steps.

In the attenuation transition zone of each sector-shaped region in the non-rectangular display area, brightness of the pixel is controlled to be gradually attenuated, and the brightness attenuation direction is a direction from the center of circle toward the curved sub-edge.

Based on the structure of the display panel, with the abovementioned method for driving the display panel, brightness of the pixels with the zigzag arrangement located at the curved edge can be lowered and thus the zigzag phenomenon is eliminated, so that the edge of the image displayed by the non-rectangular display area is closer to a smooth arc shape, besides, for pixels at the first boundary and the second boundary, only the pixels in the attenuation transition zone have brightness attenuation, and thus the brightness attenuation range of the pixels at the first boundary and the second boundary can be narrowed. Compared with the related art, the method for driving the display panel provided by this embodiment of the present disclosure can alleviate the problem of unsmooth brightness transition at the first boundary and the second boundary caused by the brightness attenuation of the pixels, so that the image displayed at the first boundary and the second boundary can be softer.

When the non-rectangular display area includes N sector-shaped regions arranged in sequence, in the attenuation transition zone of each sector-shaped region in the non-rectangular display area, the brightness of the pixel being controlled to be gradually attenuated includes following steps.

When N is an even number, the times of brightness attenuation of the pixels in respective attenuation transition zones are decreased along a direction from the $(N/2)^{th}$ sector-shaped region toward the $1^{st}$ sector-shaped region, and the times of brightness attenuation of the pixels in respective attenuation transition zones are decreased along a direction from the $(N/2+1)^{th}$ sector-shaped region toward the $N^{th}$ sector-shaped region.

When N is an odd number, the times of brightness attenuation of the pixels in respective attenuation transition zones are decreased along a direction from the $((N+1)/2)^{th}$ sector-shaped region toward the $1^{st}$ sector-shaped region, and the times of brightness attenuation of the pixels in respective attenuation transition zones are decreased along a direction from the $((N+1)/2)^{th}$ sector-shaped region toward the $N^{th}$ sector-shaped region.

The widths of respective attenuation transition zones are gradually decreased along the direction from the middle region toward both edge regions, therefore, the times of brightness attenuation of the pixels in respective attenuation transition zones can be controlled to be decreased. In this way, it is possible to avoid the situation of multiple times of brightness variations for the pixels in a narrow attenuation transition zone, so that an image presented by the respective attenuation transition zones in the non-rectangular display area can be softer.

It should be noted that the abovementioned manner for controlling brightness attenuation of the pixels is merely a specific implementation manner. In practical applications, there is a plurality of manners for controlling brightness attenuation of the pixels, as long as it can satisfy that the brightness of the pixels in each attenuation transition zone is gradually decreased along the direction from the center of circle of the sector-shaped region toward the curved sub-edge.

Figure 5:
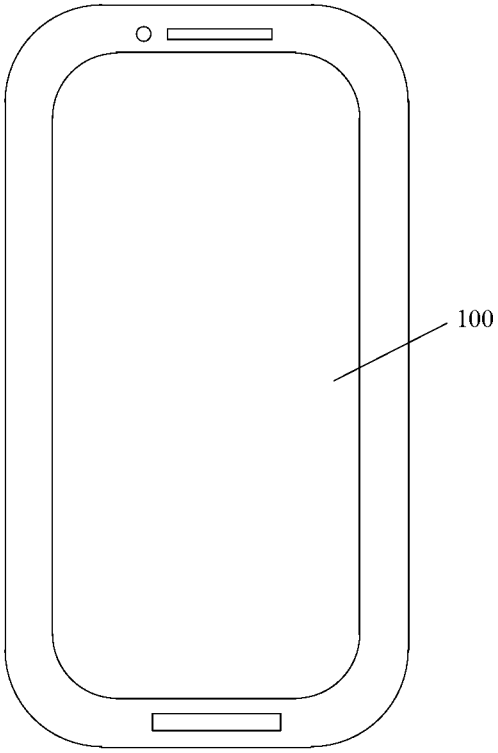
FIG. 5 is schematic structural diagram I of a display device according to an embodiment of the present disclosure.

An embodiment of the present disclosure further provides a display device. As shown in FIG. 5, the display device includes the abovementioned display panel 100. The structure of the display panel 100 and the method for driving the display panel 100 have been described in details in the above embodiments, which will not be further described herein. It should be noted that the display device shown in FIG. 5 is merely illustrative, and the display device may be any electronic device having a display function, such as a cellphone, a tablet computer, a laptop computer, an electronic paper book, or a television.

The display device provided in this embodiment includes the abovementioned display panel, therefore, the display device provided in this embodiment can eliminate the zigzag phenomenon, so that the edge of the image displayed by the non-rectangular display area is closer to a smooth arc shape, moreover, the display device can alleviate the problem of unsmooth brightness transition appearing at the boundary between the non-rectangular display area and the normal display area, so that the displayed image is softer.

Figure 6:
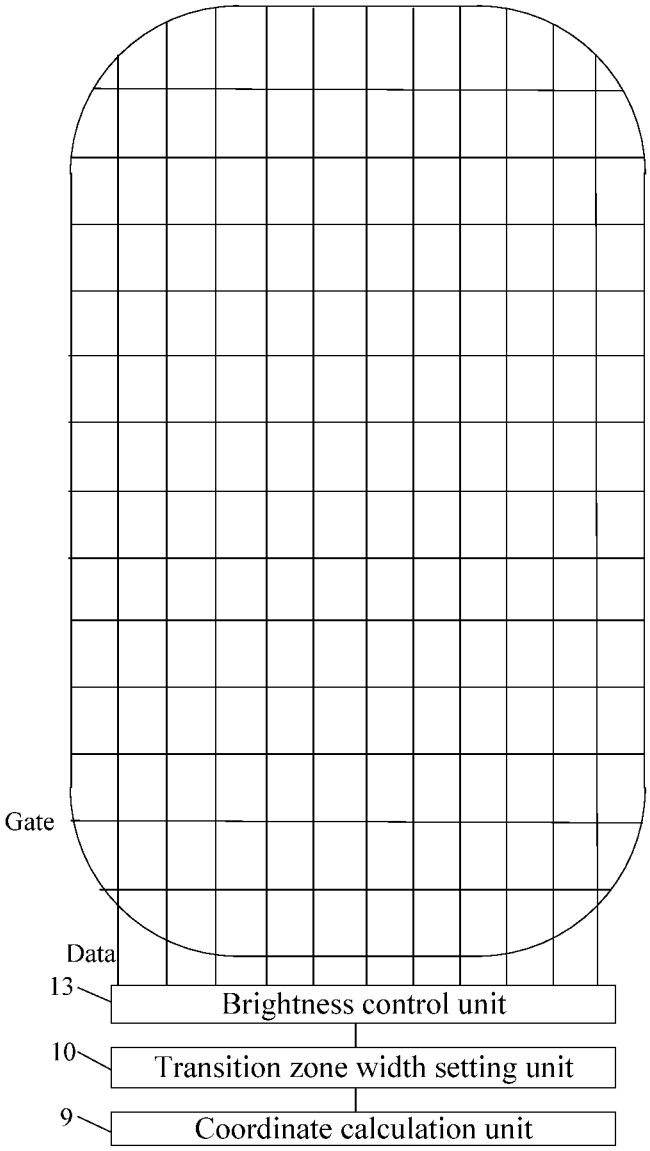
FIG. 6 is schematic structural diagram II of a display device according to an embodiment of the present disclosure.

Further, as shown in FIG. 6, the display device further includes a coordinate calculation unit 9, a transition zone width setting unit 10, and a brightness control unit 13.

The coordinate calculation unit 9 is configured to calculate a first coordinate corresponding to the curved edge in the non-rectangular display area, and a second coordinate of the center of circle corresponding to the curved edge. The transition zone width setting unit 10 is connected to the coordinate calculation unit 9, and the transition zone width setting unit 10 is configured to set the width of the attenuation transition zone of each sector-shaped region according to the calculated first coordinate and second coordinate. The brightness control unit 13 is connected to the transition zone width setting unit 10, and the brightness control unit 13 is configured to control the brightness of the pixels in each attenuation transition zone to be gradually attenuated according to the width of the attenuation transition zone.

With further reference to FIG. 6, it can be understood that a plurality of gate lines Gate and a plurality of data lines Data are disposed in the display area of the display panel, and the plurality of gate lines Gate and the plurality of data lines Data are intersected with and insulated from each other to define a plurality of pixels. When the gate line Gate corresponding to the pixel in the attenuation transition zone receives a gate scan signal, the brightness control unit 13 provides a corresponding data signal to the data line Data corresponding to the attenuation transition zone, thereby controlling the brightness of the pixels in each attenuation transition zone to be gradually attenuated.

In an embodiment, the abovementioned coordinate calculation unit 9, transition zone width setting unit 10, and brightness control unit 13 are disposed in the non-display area of the display panel and can be integrated in the driving chip.

Figure 7:
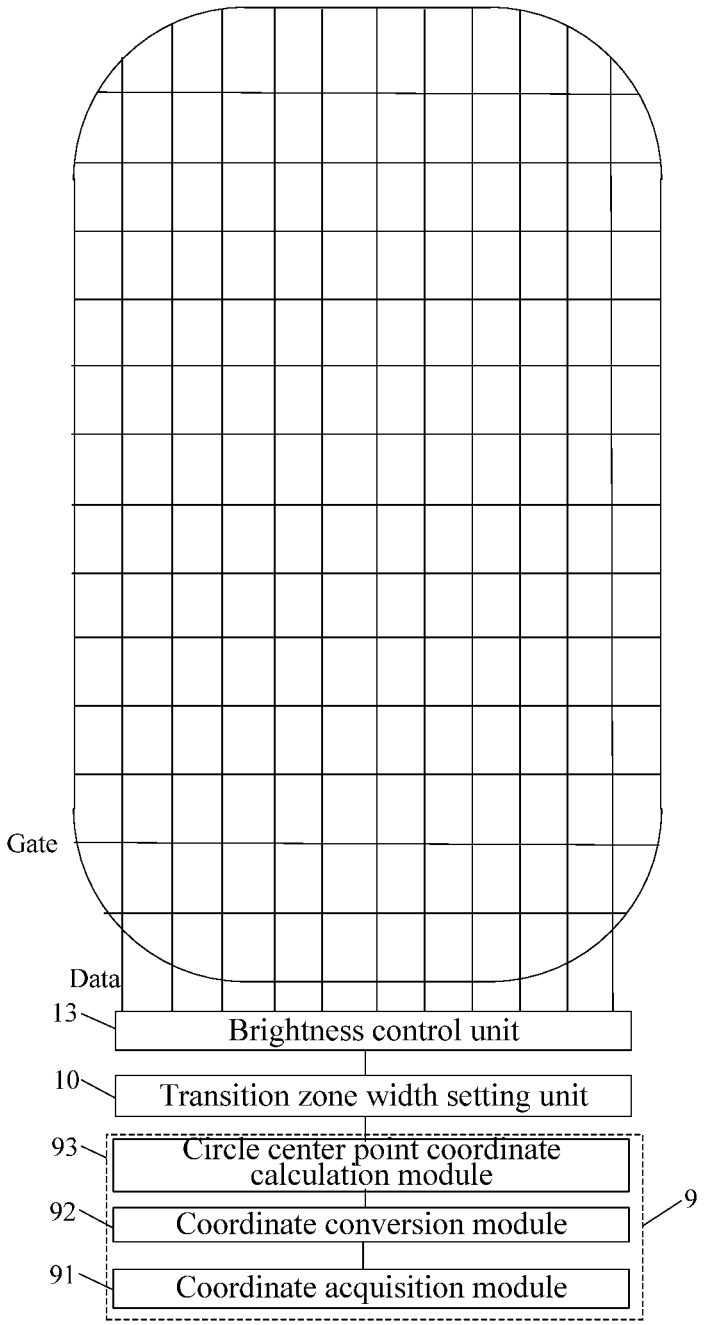
FIG. 7 is schematic structural diagram III of a display device according to an embodiment of the present disclosure.

As shown in FIG. 7, the coordinate calculation unit 9 includes a coordinate acquisition module 91, a coordinate conversion module 92, and a center of circle coordinate calculation module 93.

The coordinate acquisition module 91 is configured to acquire a third coordinate corresponding to the curved edge in the display area. The coordinate conversion module 92 is connected to the coordinate acquisition module 91 and the transition zone width setting unit 10, respectively, and the coordinate conversion module 92 is configured to convert the third coordinate into a first coordinate corresponding to the curved edge in the non-rectangular display area. The center of circle coordinate calculation module 93 is connected to the coordinate conversion module 92 and the transition zone width setting unit 10, respectively, and the center of circle coordinate calculation module 93 is configured to calculate the second coordinate of the center of circle corresponding to the curved edge according to the first coordinate.

It should be noted that the third coordinate corresponding to the curved edge in the display area refers to a coordinate corresponding to the pixel located at the curved edge in the entire display area on the basis of the entire display area. The first coordinate corresponding to the curved edge in the non-rectangular display area refers to a coordinate corresponding to the pixel located at the curved edge in the non-rectangular display area on the basis of the non-rectangular display area.

The above-described embodiments are merely preferred embodiments of the present disclosure and are not intended to limit the present disclosure. Any modifications, equivalent substitutions and improvements made within the principle of the present disclosure shall fall into the protection scope of the present disclosure.

What is claimed is:

1. A display panel, comprising a display area, wherein the display area comprises a main display area and at least one auxiliary display area, and each of the at least one auxiliary display area has a smaller length than the main display area in a row direction, each of the at least one auxiliary display area comprises a first display area and at least one non-rectangular display area, and each of the at least one non-rectangular display area has a curved edge; a first boundary is between each of the at least one non-rectangular display area and the first display area, and a second boundary is between each of the at least one non-rectangular display area and the main display area;

one non-rectangular display area of the at least one non-rectangular display area comprises a plurality of sector-shaped regions, the curved edge of the one non-rectangular display area comprises a plurality of curved sub-edges, each of the plurality of sector-shaped regions corresponds to a respective one of the plurality of curved sub-edges, and each of the plurality of sector-shaped regions has a vertex that is a center of circle corresponding to the respective curved edge;

each of the plurality of sector-shaped regions has an attenuation transition zone, the attenuation transition zone has a width smaller than a radius of one of the plurality of sector-shaped regions where the attenuation transition zone is located; both a width of the attenuation transition zone of one of the plurality of sector-shaped regions adjacent to the first boundary and a width of the attenuation transition zone of one of the plurality of sector-shaped regions adjacent to the second boundary are smaller than a width of the attenuation transition zone of any one of other sector-shaped regions; and a brightness of pixels in each attenuation transition zone is gradually attenuated along a direction from the center of a circle toward a corresponding one of the plurality of curved sub-edges.

2. The display panel according to claim 1, wherein the display area comprises two auxiliary display areas, and each of the two auxiliary display areas comprises two non-rectangular display areas;

in each of the two auxiliary display areas, one of the two non-rectangular display areas, the first display area, and the other one of the two non-rectangular display areas are sequentially arranged in the row direction.

3. The display panel according to claim 1, wherein one of the at least one non-rectangular display area comprises N sector-shaped regions that are arranged sequentially, wherein a $1^{st}$ sector-shaped region is adjacent to the first boundary, and an $N^{th}$ sector-shaped region is adjacent to the second boundary;

when N is an even number, widths of the plurality of attenuation transition zones of the plurality of sector-shaped regions are decreased along a direction from a $(N/2)^{th}$ sector-shaped region toward the $1^{st}$ sector-shaped region; and widths of the plurality of attenuation transition zones of the plurality of sector-shaped regions are decreased along a direction from a $(N/2+1)^{th}$ sector-shaped region toward the $N^{th}$ sector-shaped region; and when N is an odd number, widths of the plurality of attenuation transition zones of the plurality of sector-shaped regions are decreased along a direction from $((N+1)/2)^{th}$ sector-shaped region toward the $1^{st}$ sector-shaped region; and widths of the plurality of attenuation transition zones of the plurality of sector-shaped regions are decreased along a direction from the $((N+1)/2)^{th}$ sector-shaped region toward the $N^{th}$ sector-shaped region.

4. The display panel according to claim 3, wherein the plurality of sector-shaped regions has a same angle.

5. The display panel according to claim 4, wherein an absolute value of an angle between an $x^{th}$ sector-shaped region and a center line of the curved edge is equal to an absolute value of an angle between a $y^{th}$ sector-shaped region and the center line of the curved edge, and a width of the attenuation transition zone of the $x^{th}$ sector-shaped region is equal to a width of the attenuation transition zone of the $y^{th}$ sector-shaped region, wherein $1 \le x \le N$, and $1 \le y \le N$.

6. The display panel according to claim 4, wherein when N is an even number, for each of the $(N/2)^{th}$ sector-shaped region to the $1^{st}$ sector-shaped region, a width of the attenuation transition zone and an angle between the respective sector-shaped region and the center line of the curved edge satisfy a first linear relation; for each of the $(N/2+1)^{th}$ sector-shaped region to the $N^{th}$ sector-shaped region, a width of the attenuation transition zone and an angle between the respective sector-shaped region and the center line of the curved edge satisfy a second linear relation; and when N is an odd number, for each of the $((N+1)/2)^{th}$ sector-shaped region to the $1^{st}$ sector-shaped region, a width of the attenuation transition zone and an angle between the respective sector-shaped region and the center line of the curved edge satisfy a third linear relation; for each of the $((N+1)/2)^{th}$ sector-shaped region to the $N^{th}$ sector-shaped region, a width of the attenuation transition zone and an angle between the respective sector-shaped region and the center line of the curved edge satisfy a fourth linear relation.

7. The display panel according to claim 6, wherein the first linear relation is identical to the second linear relation, and the third linear relation is identical to the fourth linear relation.

8. A method for driving a display panel, applied to the display panel according to claim 1, wherein the method comprises:

controlling the brightness of pixels to be gradually attenuated in the attenuation transition zone of each sector-shaped region in the non-rectangular display area along a direction from the center of the circle toward the curved sub-edge.

9. The method according to claim 8, wherein the non-rectangular display area comprises N sector-shaped regions arranged in sequence, and the controlling brightness of pixels to be gradually attenuated in the attenuation transition zone of each sector-shaped region in the non-rectangular display area comprises:

when N is an even number, a number of times of brightness attenuation of the pixels in respective attenuation transition zones is decreased along a direction from the $(N/2)^{th}$ sector-shaped region toward the $1^{st}$ sector-shaped region, and a number of times of brightness attenuation of the pixels in respective attenuation transition zones is decreased along a direction from the $(N/2+1)^{th}$ sector-shaped region toward the $N^{th}$ sector-shaped region;

when N is an odd number, a number of times of brightness attenuation of the pixels in respective attenuation transition zones is decreased along a direction from the $((N+1)/2)^{th}$ sector-shaped region toward the $1^{st}$ sector-shaped region, and a number of times of brightness attenuation of the pixels in respective attenuation transition zones is decreased along a direction from the $((N+1)/2)^{th}$ sector-shaped region toward the $N^{th}$ sector-shaped region.

10. A display device, comprising the display panel according to claim 1.

11. The display device according to claim 10, wherein the display device further comprises:

a coordinate calculation unit configured to calculate a first coordinate corresponding the curved edge in the non-rectangular display area and a second coordinate of the center of circle corresponding to the curved edge;

a transition zone width setting unit connected to the coordinate calculation unit and configured to set the width of the attenuation transition zone of each sector-shaped region according to the calculated first coordinate and second coordinate; and a brightness control unit connected to the transition zone width setting unit and configured to control the brightness of the pixels in each attenuation transition zone to be gradually attenuated according to the set width of the attenuation transition zone.

12. The display device according to claim 11, wherein the coordinate calculation unit comprises:

a coordinate acquisition module configured to acquire a third coordinate corresponding of the curved edge in the display area;

a coordinate conversion module connected to the coordinate acquisition module and the transition zone width setting unit and configured to convert the third coordinate into the first coordinate corresponding to the curved edge in the non-rectangular display area; and a center of circle coordinate calculation module connected to the coordinate conversion module and the transition zone width setting unit and configured to calculate the second coordinate of the center of circle corresponding to the curved edge according to the first coordinate.

* * * * *